US007690742B2

(12) United States Patent
Han

(10) Patent No.: US 7,690,742 B2
(45) Date of Patent: Apr. 6, 2010

(54) INKJET PRINTER HEAD DRIVING APPARATUS AND CONTROL METHOD THEREOF

(75) Inventor: Eun-Bong Han, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 37 days.

(21) Appl. No.: 10/720,173

(22) Filed: Nov. 25, 2003

(65) Prior Publication Data

US 2004/0109036 A1 Jun. 10, 2004

(30) Foreign Application Priority Data

Dec. 6, 2002 (KR) ..... 10-2002-0077320

(51) Int. Cl.
*B41J 29/38* (2006.01)

(52) U.S. Cl. ..... 347/9; 347/12

(58) Field of Classification Search ..... 347/9, 347/10, 11, 12, 90
See application file for complete search history.

(56) References Cited

U.S. PATENT DOCUMENTS 5,504,505 A * 4/1996 Tamura et al. ..... 347/13
5,519,416 A * 5/1996 Hayasaki et al. ..... 347/13
5,975,670 A * 11/1999 Kikuta et al. ..... 347/15
6,116,714 A * 9/2000 Imanaka et al. ..... 347/19
6,273,537 B1 * 8/2001 Hiwada ..... 347/10
6,382,755 B1 * 5/2002 Imanaka et al. ..... 347/12
6,471,324 B1 * 10/2002 Maru ..... 347/19
6,515,523 B1 * 2/2003 Bikulcius ..... 327/142
6,528,925 B1 * 3/2003 Takeuchi et al. ..... 310/316.03
6,844,658 B2 * 1/2005 Hoshino ..... 310/316.03
7,006,068 B2 * 2/2006 Haga ..... 345/98
2003/0001911 A1 * 1/2003 Hirayama et al. ..... 347/9

FOREIGN PATENT DOCUMENTS

JP 11-138775 5/1999

OTHER PUBLICATIONS

Japanese Office Action dated Dec. 26, 2006 issued in JP 2003-409265.

* cited by examiner

*Primary Examiner*—Stephen D Meier
*Assistant Examiner*—Leonard S Liang
(74) *Attorney, Agent, or Firm*—Stanzione & Kim, LLP

(57) ABSTRACT

An inkjet printer head driving apparatus and a control method thereof include a switching unit turning on and off each of heating elements to heat and eject ink through nozzles, a level shift unit having a level converter converting to a predetermined potential level a potential level of a signal inputted to drive the switching unit, a transient time extending part provided with at least one time extending element to extend a transient time during which a potential level of the signal inputted from the level converter to the switching unit is converted from a first signal level to a second signal level and vice versa, and a control unit outputting to the level shift unit the delayed signal as a nozzle selection signal to select the nozzles corresponding to a to-be-recorded image.

30 Claims, 7 Drawing Sheets

INKJET PRINTER HEAD DRIVING APPARATUS AND CONTROL METHOD THEREOF

CROSS-REFERENCE TO RELATED APPLICATIONS

This application claims the benefit of Korean Patent Application No. 2002-77320 filed Dec. 6, 2002 in the Korean Intellectual Property Office, the disclosure of which is incorporated herein by reference.

BACKGROUND OF THE INVENTION

1. Field of the Invention

The present invention relates to an inkjet printer head driving apparatus and a control method thereof, and more particularly, to an inkjet printer head driving apparatus and a control method to minimize high-frequency noise components which may occur as a heating element is driven to eject ink through nozzles formed on a printer head.

2. Description of the Related Art

In general, a printer prints images or information processed by an external device, such as a computer, on a recording medium, such as a sheet of paper. The printer is mainly classified into one of a wire dot type, a thermal transfer type, and an inkjet type.

An inkjet printer head has a plurality of nozzles ejecting ink to form the images on the recording medium. The inkjet printer head of a printing mechanism in an inkjet printer functions to complete a printing job as requested, and is driven by a head driving device to fulfill printing jobs by ejecting an appropriate amount of printing ink on the recording medium.

FIG. 1 is a block diagram explaining a head driving device 100 of a conventional inkjet printer.

As shown in FIG. 1, the head driving device 100 for the inkjet printer includes a logic control unit 110, a latch unit 120, a gate array 130, a level shift unit 140, and a switching unit 150.

The logic control unit 110 has a decoder 112 to receive an encoded data signal from a microcomputer (not shown) controlling overall operations of the inkjet printer, and decoding the encoded data signal, and a shift register 114 synchronized with a clock signal CLOCK of a clock terminal thereof to receive data decoded in the decoder 112 and output the data to the latch unit 120.

The latch unit 120 latches data decoded in the logic control unit 110 according to a latch signal LATCH.

The gate array 130 includes a plurality of AND gates connected to receive an output signal of the latch unit 120 and a strobe pulse signal STRB to determine a heating time of heating elements R.

As shown in FIG. 2, the level shift unit 140 includes a level converter 142 and a buffer 144.

The level converter 142 raises a potential level of data transmitted from the gate array 130. For example, if the potential level ranging from 0V to 5V is outputted from the gate array 130, the level converter 142 steps up the potential level to an optimum driving potential level for the switching unit 150 which drives the heating elements R.

The buffer 144 buffers a voltage outputted from the level converter 142, shapes a waveform of the output voltage, delays the output voltage of the level converter 142 for a predetermined time, and outputs a result, such as the delayed output voltage.

The switching unit 150 is connected to cause a power supply Vph to be supplied to turn on and off the heating elements R according to output signals of the level shift unit 140. The switching unit 150 includes a plurality of FETs 152 used as switching devices and coupled between the power supply Vph and ground GND.

That is, the potential levels outputted from the level shift unit 140 are transmitted to gates of the FETs 152 of the switching unit 150 to form current paths between drains and sources, thereby heating the heating elements R to eject ink from selected nozzles.

FIG. 3 is a circuit diagram schematically showing a part of a printer head 170 connected to a flexible printed circuit board (FPCB) 160 to explain how an LC resonant circuit formed on the FPCB and the printer head affects the printer head as the switching unit for driving the heating elements R is turned on.

Referring to FIG. 3, the FPCB 160 is a printed board having wirings formed thereon to transmit electric power and electric signals to the printer head 170. FPCB cables of the FPCB 160 are coupled with bonding pads 172 provided in the printer head 170 to electrically connect the printer head 170 with a printer system.

At this time, the FPCB 170 includes resistance components R1 and R2 and inductance components L1 and L2 on the FPCB cables, and internal power lines of the printer head 170, connected with the FPCB through the bonding pads, have resistance components R3 and R4.

Further, the printer head 170 is generally attached to one side of an ink cartridge, and has a plurality of nozzles (not shown) through which ink is ejected, the heating elements R heating the ink to eject the ink through the nozzles, and the bonding pads 172.

As shown in FIG. 3, between a head power terminal $V_{ph}$ and the ground GND are connected in series the inductance components L1 and L2 and the resistance components R1 and R2 of the FPCB cables, the heating element R formed on the printer head 170, the FET 152 driving the heating element R, and resistors R3 and R4. Further, a capacitor C2 is connected in parallel with the heating element R between head power terminal (power supply) $V_{ph}$ and the ground GND.

Here, the FET 152 switches on and off according to an output signal of the gate array 130. For example, the FET 152 is turned on if a high-level signal is outputted from the gate array 130, and is turned off if a low-level signal is outputted from the gate array 130.

If the FET 152 is turned on with an output signal of the level shift unit 140, electric current flows through the heating element R, which forms an LC resonant circuit of the inductance component L1 and the capacitor C2 between the head power terminal $V_{ph}$ and the ground GND. Accordingly, as shown in FIGS. 4A through 4D, waveforms, such as a voltage VPH of the head power terminal $V_{ph}$ and a current waveform IR of the heating element R, are oscillated when the heating element R is driven with voltages A and B, and the oscillations are attenuated due to resistances of the heating element R and the resistance components R1 to R4 of power lines so that the voltage and current waveforms VPH and IR return to their original states. At this time, a resonant frequency becomes $$\frac{1}{2\pi\sqrt{LC}}$$

which is generated in the LC resonant circuit. That is, the resonant frequency is changed by an inductance component L and a capacitance component C. Accordingly, as the inductance component L and the capacitance component C between the head power terminal $V_{ph}$ and the ground GND become larger, oscillating periods of the waveforms become longer.

The inductance component L occurring from the inductance components L1 and L2 becomes larger as the FPCB cables are extended. Further, the capacitance component C becomes a total sum of parasitic capacitances occurring among the gate, source, and drain of the FET 152 times the total number of the FETs 152, and a value of the capacitance component C becomes larger as the FETs 152 is scaled up in each size or in number.

In the meantime, since the FETs 152 are in a high impedance state when the FETs 152 are turned off, an oscillation attenuation effect due to the resistance components R1 to R4 is ignored so that the oscillations continue longer than at the time the FETs 152 are turned on.

Further, the more driven the FETs 152 are at the same time, the higher an oscillation level of the head power terminal $V_{ph}$ becomes, which causes an electrical state of the printer head 170 to be unstable so that the printer head 170 may be broken down, and which causes high-frequency signals to be supplied to the power lines so that electromagnetic interference (EMI) characteristics may become worse.

Accordingly, in order to minimize the influence of the capacitance and inductance components, the rising/falling times of a gate signal of the FETs 152 have to be designed large enough in consideration of a capacitor charging/discharging time. However, since the FETs 152 are manufactured using a plurality of semiconductor processes, it is difficult to meet the above requirements.

SUMMARY OF THE INVENTION

In an effort to solve the above and/or other problems, it is an aspect of the present invention to provide an inkjet printer head driving apparatus and a control method to decrease high-frequency components occurring when switching devices are driven by impedance components formed around the switching devices driving heating elements.

Additional aspects and advantages of the invention will be set forth in part in the description which follows and, in part, will be obvious from the description, or may be learned by practice of the invention.

In order to achieve the above and/or other aspects and other features of the present invention, an inkjet printer head driving apparatus includes a switching unit turning on and off each of heating elements to heat ink corresponding to nozzles through which the ink is ejected, a level shift unit having a level converter to convert to a potential level of a signal inputted to drive the switching unit, and a transient time extending part provided with at least one time extending element to extend by a predetermined time a transient time during which the potential level of the signal inputted from the level converter to the switching unit is converted from a first signal level to a second signal level and vice versa, and a control unit receiving an external data signal, decoding the received data signal, and outputting to the level shift unit the decoded signal as a nozzle selection signal to select nozzles corresponding to a to-be-recorded image.

It is possible that the inkjet printer head driving apparatus further includes a discharging part discharging a residual voltage of a signal inputted from the level shift unit to a gate of the switching unit if the switching unit switching on and off the heating elements is turned off.

The transient time extending part includes a first inverter inverting the signal outputted from the level converter, and a second inverter to extend the first transient time from the first signal level to the second signal level or a second transient time from the second signal level to the first signal level according to an output signal of the first inverter.

The second inverter includes a first PMOS having a source connected to a voltage supply and a gate and a drain commonly connected, a second PMOS having a source connected to the drain of the first PMOS and a gate connected to an output terminal of the first inverter, a first NMOS having a gate commonly connected to the gate of the second PMOS and a drain connected to a drain of the second PMOS to form an output terminal of the second inverter, and a second NMOS having a drain and a gate commonly connected to the source of the first NMOS and a source connected to the ground.

In the meantime, the discharging part includes a first logic device connected to receive an output signal of the level converter and an output signal of the transient time extending part, a third inverter receiving an output signal of the first logic device, a third NMOS connected to receive an output signal of the third inverter, and having a gate thereof connected to an output terminal of the third inverter, a drain thereof connected to an input terminal of the switching unit, and a source thereof connected to the ground.

Further, in order to achieve the above and/or other aspects of the present invention, a control method used with an inkjet printer head driving apparatus having a switching unit driving heating elements corresponding to selected nozzles through which ink is ejected, includes outputting a nozzle selection signal to select nozzles corresponding to a to-be-recorded image, receiving an inputted signal corresponding to the nozzle selection signal and converting a level of the inputted signal to a predetermined potential level to drive the switching unit, extending a transient time by a predetermined period of time in accordance with an output signal generating when the level of the inputted signal is converted, the transient time being a time during which the level is converted from a first signal level to a second signal level and vice versa, and driving the heating elements corresponding to the selected nozzles to eject ink through the selected nozzles based on a signal outputted from a transient time extending operation of delaying the inputted signal.

The transient time extending operation includes extending a first transient time during which the first signal level is converted to the second signal level, and extending a second transient time during which the second signal level is converted to the first signal level.

In order to achieve the above and/or other aspects of the present invention, an inkjet printer head driving apparatus having a plurality of heating elements and nozzles includes a control unit generating a control nozzle selection signal to select a heating element and a nozzle corresponding to an image to be printed, a level shift unit generating a first nozzle selection signal having a first transient time, during which a level of the first nozzle selection signal is changed between first and second levels, in response to the control nozzle selection signal, and generating a second nozzle selection signal having a second transient time extended by a period from the first transient time; and a switching unit turning on and off the heating element according to the second nozzle selection signal.

According to another aspect of the present invention, the apparatus further includes a discharging part discharging a residual voltage of the switching unit according to the first nozzle selection signal and/or the second nozzle selection signal.

According to another aspect of the present invention, the switching unit includes a transistor having a first terminal coupled to the level shift unit and the discharging part, a second terminal coupled to the heating element, and a third terminal connected to a potential, and the residual voltage of the switching unit is a voltage of the first terminal.

According to another aspect of the present invention, the discharging part is coupled to the level shift unit to receive the first and second nozzle selection signal so that the residual voltage of the switching unit is discharged according to at least one of the first nozzle selection signal and the second nozzle selection signal when the switching unit is turned on and/or off according to the second nozzle selection signal.

According to another aspect of the present invention, the first nozzle selection signal comprises a first rising transient time and a first falling transient time, during which a level of the first nozzle selection signal is changed between first and second levels, in response to the control nozzle selection signal, and the second nozzle selection signal comprises a second rising transient time and a second falling transient time, during which a level of the second nozzle selection signal is changed between third and fourth levels, extended by first and second periods from the first transient time and the second transient time, respectively.

According to another aspect of the present invention, the second rising and falling transient times are longer that the first rising and falling transient times, respectively.

According to another aspect of the present invention, the second transient time of the second nozzle selection signal has a period longer than that of the first transient time of the first nozzle selection signal.

According to another aspect of the present invention, the second nozzle selection signal comprises a transient level disposed between the third and fourth levels during the second transient time, and the transient level comprises a first sub-transient level and a second sub-transient level.

According to another aspect of the present invention, one of the first sub-transient level and the second sub-transient level of the transient level of the second nozzle selection signal has a period longer than the first transient time of the first nozzle selection signal.

According to another aspect of the present invention, the switching unit is turned off according to the second nozzle selection signal while the discharging part discharges the residual voltage of the switching unit according to the first transient time of the first nozzle selection signal.

According to another aspect of the present invention, the first sub-transient level is not linear between the first level and the second sub-transient level, and the second sub-transient level is linear between the first sub-transient level and the second level.

According to another aspect of the present invention, the first nozzle selection signal comprises a previous first nozzle selection signal and a current first nozzle selection signal, and the second nozzle selection signal comprises a previous second nozzle selection signal and a current second nozzle selection signal corresponding to the previous first nozzle selection signal and the current first nozzle selection signal of the first nozzle selection signal, respectively, and the voltage of the switching unit is a residual voltage remaining in the switching unit when the switching unit is turned off according to the previous second nozzle selection signal.

According to another aspect of the present invention, the voltage of the switching unit is another residual voltage remaining in the switching unit when the switching unit is turned off according to the current second nozzle selection signal.

According to another aspect of the present invention, the first nozzle selection signal comprises first and second levels and first rising and falling transient times disposed between the first and second levels and second levels, the second nozzle selection signal comprises third and fourth levels and second rising and falling transient times disposed between the third and fourth levels, and one of the second rising and falling transient times of the second nozzle selection signal has a period longer than either one of the first rising and falling transient times of the first nozzle selection signal.

According to another aspect of the present invention, the third level of the second nozzle selection signal is disposed between the first rising and falling transient times of the second nozzle selection signal and has a period shorter than that of the first level of the first nozzle selection signal disposed between the first rising and falling transient times.

According to another aspect of the present invention, the second rising transient time is extended from the first rising transient time by a first period so that the discharging part discharges the voltage of the switching unit according to the first rising transient time of the first nozzle selection signal before the switching unit is turned on according to one of the third and fourth levels of the second nozzle selection signal.

According to another aspect of the present invention, the discharging part discharges the voltage of the switching unit during the second transient time of the second nozzle selection signal when the switching unit is changed between a turn-off state to a turn-on state according to the second nozzle selection signal.

According to another aspect of the present invention, the discharging part discharges the voltage of the switching unit according to the transient time of the second nozzle selection signal and/or the first nozzle selection signal.

BRIEF DESCRIPTION OF THE DRAWINGS

These and/or other aspects and advantages of the present invention will become apparent and more readily appreciated from the following description of the embodiments, taken in conjunction with the accompanying drawings of which.

DETAILED DESCRIPTION OF THE PREFERRED EMBODIMENTS

Figure 1:
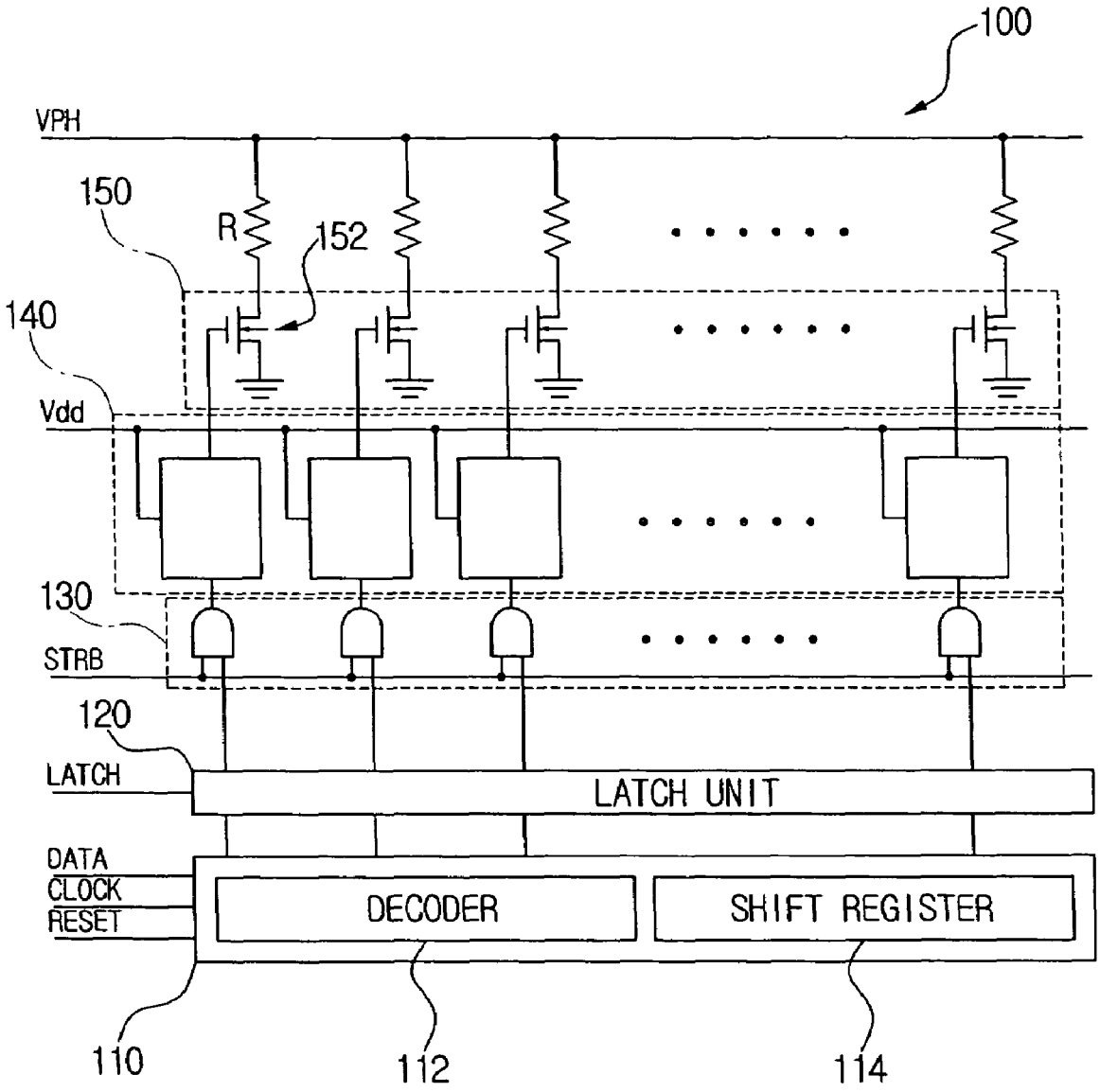
FIG. 1 (PRIOR ART)
FIG. 1 is a block diagram showing a conventional inkjet printer head driving apparatus.
Figure 2:
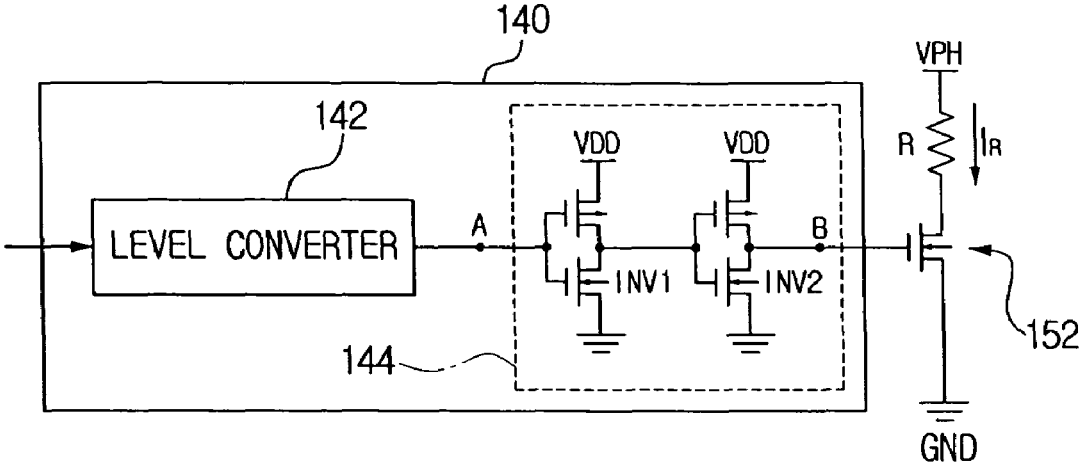
FIG. 2 (PRIOR ART)
FIG. 2 is a view showing a circuit of a level shift unit of the inkjet printer head driving apparatus shown in FIG. 1.
Figure 3:
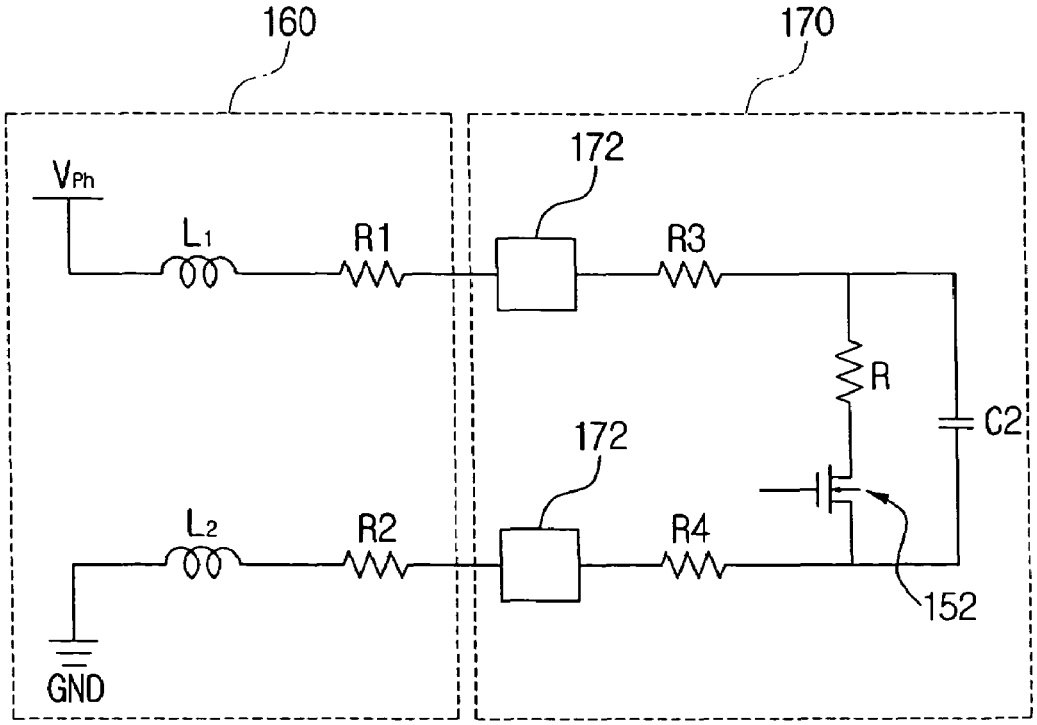
FIG. 3 (PRIOR ART)
FIG. 3 is a view schematically showing a portion of a circuit of a printer head connected to a flexible printed circuit board of the inkjet printer head driving apparatus shown in FIG. 1.
Figure 4:
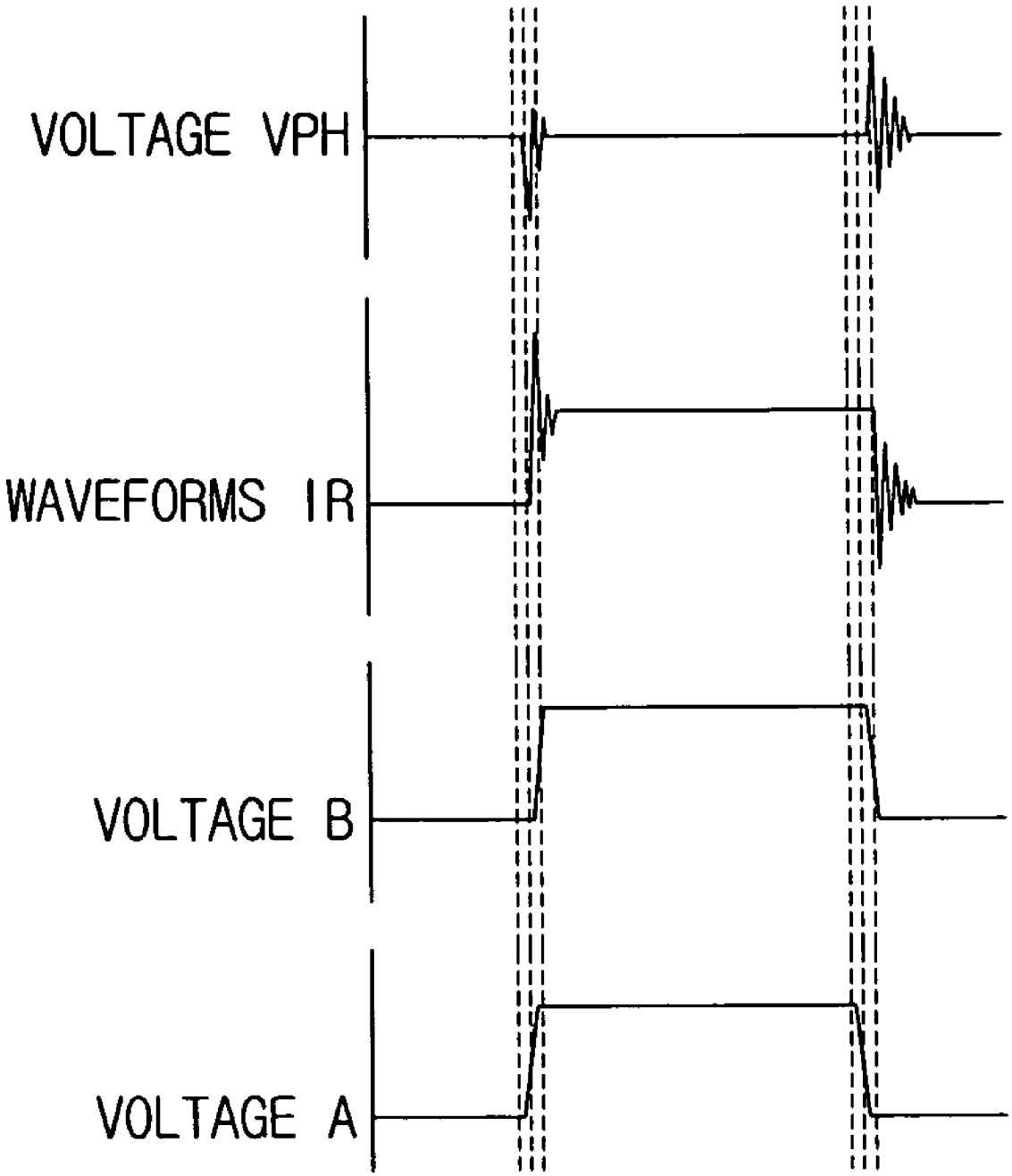
FIG. 4 (PRIOR ART)
FIG. 4 is a view showing waveforms of output terminals of the level shift unit of FIGS. 1 and 2.

Reference will now be made in detail to the embodiments of the present invention, examples of which are illustrated in the accompanying drawings, wherein like reference numerals refer to the like elements throughout. The embodiments are described below in order to explain the present invention by referring to the figures.

Figure 5:
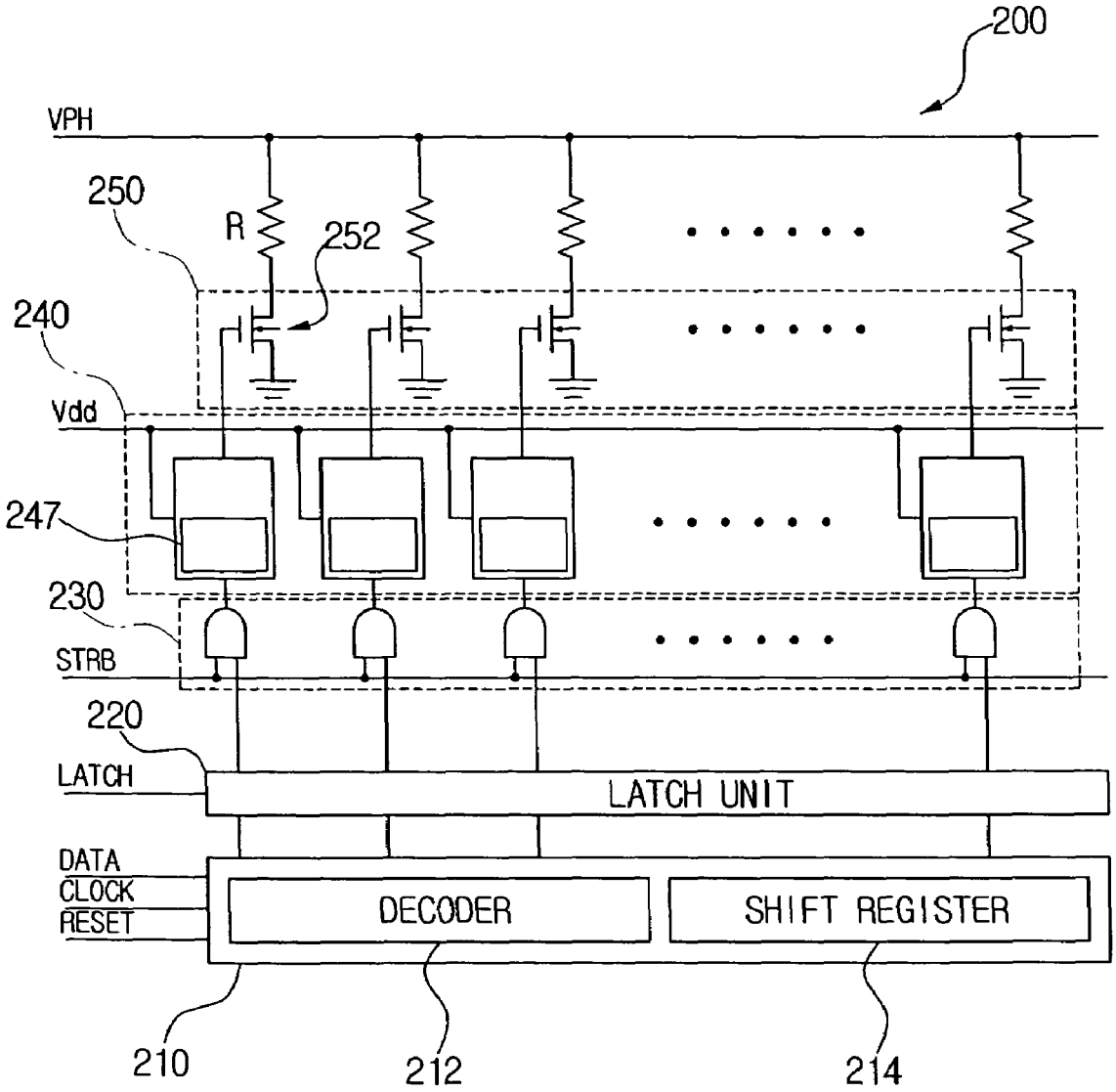
FIG. 5 is a block diagram illustrating an inkjet printer head driving apparatus according to an embodiment of the present invention.

FIG. 5 is a block diagram explaining an inkjet printer head driving apparatus 200 according to an embodiment of the present invention. Referring to FIG. 5, the inkjet printer head driving apparatus 200 has a control unit 210, a latch unit 220, a gate array 230, a level shift unit 240, and a heating element switching unit 250.

The control unit 210 is controlled by a microcomputer (not shown) controlling overall operations of an inkjet printer, and is provided with a decoder 212 and a shift register 214.

The decoder 212 receives and decodes a data signal DATA encoded and transmitted from the microcomputer, and outputs the decoded data signal to the shift register 214.

The shift register 214 outputs to the latch unit 220 the decoded data signal as nozzle selection signals according to a clock signal CLOCK to select some nozzles (not shown) formed on a printer head corresponding to a to-be-printed image based on the decoded data signal of the decoder 212.

The latch unit 220 latches the data signal inputted from the shift register 214 in response to a latch signal LATCH. That is, the latch unit 220 stores currently inputted data until a corresponding enable signal is inputted so that the currently inputted data is prevented from being affected by next data. The nozzle selection signals outputted from the shift register 214 by latch operations of the latch unit 220 are transmitted to the gate array 230 at the same timing.

The gate array 230 includes a plurality of AND gates each connected to receive output signals of the latch unit 220 and a strobe pulse signal STRB of the microcomputer (not shown) to determine a period of time for heating elements R corresponding to the selected nozzles. Output terminals of the gate array 230 are connected to input terminals of the level shift unit 240. The gate array 230 outputs a control nozzle selection signal having high-level or low-level signals based on a result of comparisons of the above two signals, that is, the output signals of the latch unit 220 and the strobe pulse signal STRB of the microcomputer. That is, the gate array 230 outputs potential levels ranging from +3.3V to +5V as the control nozzle selection signal in a case that the above two signals are the high level signal according to characteristics of the AND gates.

Figure 6:
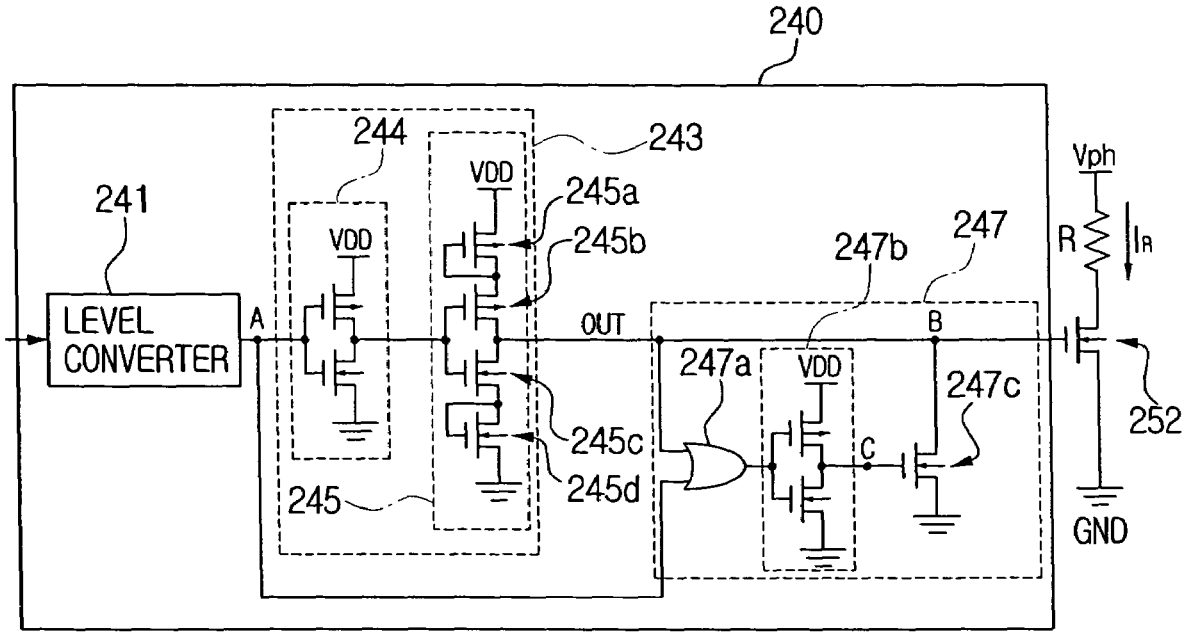
FIG. 6 is a view showing a circuit of a level shift unit of the inkjet printer head driving apparatus shown in FIG. 5.

FIG. 6 is a view showing a circuit of the level shift unit 240 of FIG. 5. As shown in FIGS. 5 and 6, the level shift unit 240 has a level converter 241, a transient time extending part 243, and a discharging part 247.

The level converter 241 converts a potential level of a signal inputted in response to a signal (control nozzle selection signal) outputted from the gate array 230 into another potential level to drive the switching unit 250. For example, if the high-level signal between +3.3V to +5V is outputted from the gate array 230, the level converter 241 converts the potential level into an optimal driving potential level, e.g., a first nozzle selection signal, to drive the switching unit 250.

The transient time extending part 243 has one or more time extending elements 245*a* and 245*d* to prolong a transient time by a predetermined time to output a second nozzle selection signal according to the first nozzle selection signal. Here, the transient time is the time period during which the potential level of the signal (first nozzle selection signal) inputted from the level converter 241 to the switching unit 250 is converted from a first signal level to a second signal level and vice versa. Also, the first signal level is a signal of logic "high" and the second signal level is a signal of logic "low."

That is, in a case that the first signal level is converted into the second signal level or the second signal level is converted into the first signal level, the transient time extending part 243 extends the transient time taken to convert a signal level into a different signal level for a predetermined time longer, so as to slow down a switching rate of the switching unit 250.

As shown in FIG. 6, the transient time extending part 243 has a first inverter 244 and a second inverter 245. The first inverter 244 inverts a signal outputted from the level converter 241.

The second inverter 245 extends a time period during which the first signal level is converted to the second signal level and a time period during which the second signal level is converted to the first signal level.

The second inverter 245 includes a first PMOS 245*a* having a source connected to a voltage supply Vdd and a gate and a drain commonly connected to each other, a second PMOS 245*b* having a source connected to the drain of the first PMOS 245*a* and a gate connected to an output terminal of the first inverter 244, a first NMOS 245*c* having a gate commonly connected to the gate of the second PMOS 245*b* and a drain connected to the drain of the second PMOS 245*b* to form an output terminal of the second inverter 245, and a second NMOS 245*d* having a drain and a gate commonly connected to the source of the first NMOS 245*c* and a source connected to the ground.

Here, the first PMOS 245*a* extends a time period during which a driving voltage of the voltage supply VDD is applied to the output terminal of the second inverter 245, and the second NMOS 245*d* extends a time period during which a voltage of the output terminal is discharged to the ground GND. Accordingly, the period of time taken to convert the output voltage of the level converter 241 from "low" to "high" and vice versa is extended according to the time extension in the first PMOS 245*a* and second NMOS 245*d* of the second inverter 245.

In the meantime, the first PMOS 245*a* and the second NMOS 245*d* are used as time extending elements of the second inverter 245 in the present embodiment, but diodes and transistors, or any other elements that perform the operation intended by the present invention, may be used to implement the embodiment. In a case that the transistors are used, the embodiment can be implemented by connecting a base and an emitter of a transistor like a diode. Further, in addition to the illustrative elements, any element can be applied if transient time for a voltage outputted from the output terminal of the second inverter 245 can be extended for a certain period of time.

The discharging part 247 discharges the output signal of the second inverter 245 as a gate voltage of the switching unit 250 if the switching unit 250 turning on and off the heating elements R is turned off. That is, the discharging of the output signal of the second inverter 245 is to prevent malfunctions occurring due to an incomplete discharge of the gate voltage of an FET 252 even if the FET 252 is turned off due to a time delayed by the second PMOS 245*b*.

The discharging part 247 includes a first logic element 247*a* connected to receive an output signal (first nozzle selection signal) of the level converter 241 and an output signal (second nozzle selection signal) of the second inverter 245, a third inverter 247*b* receiving an output signal of the first logic element 247*a*, and a third NMOS 247*c* having a gate connected to the output terminal of the third inverter 247*b*, a drain connected to the input terminal of the switching unit 250, and a source grounded.

The third NMOS 247*c* is turned on according to an output of a high-level signal outputted from the third inverter 247*b*. The third inverter 247*b* outputs the high-level signal only when there is a low-level signal output from an OR gate employed as the first logic element 247*a*. As the third NMOS 247*c* is turned on, a residual charge remaining in the gate of the FET 252 is discharged through the source end of the third NMOS 247*c*.

That is, the discharging part 247 operates only if one of the output signals (first and second nozzle selection signals) of the level converter 241 and the second inverter 245 is in the low level, so that the gate voltage of the switching unit 250 can be completely discharged in a case that the switching unit 250 driving the heating elements R is turned off.

Figure 7:
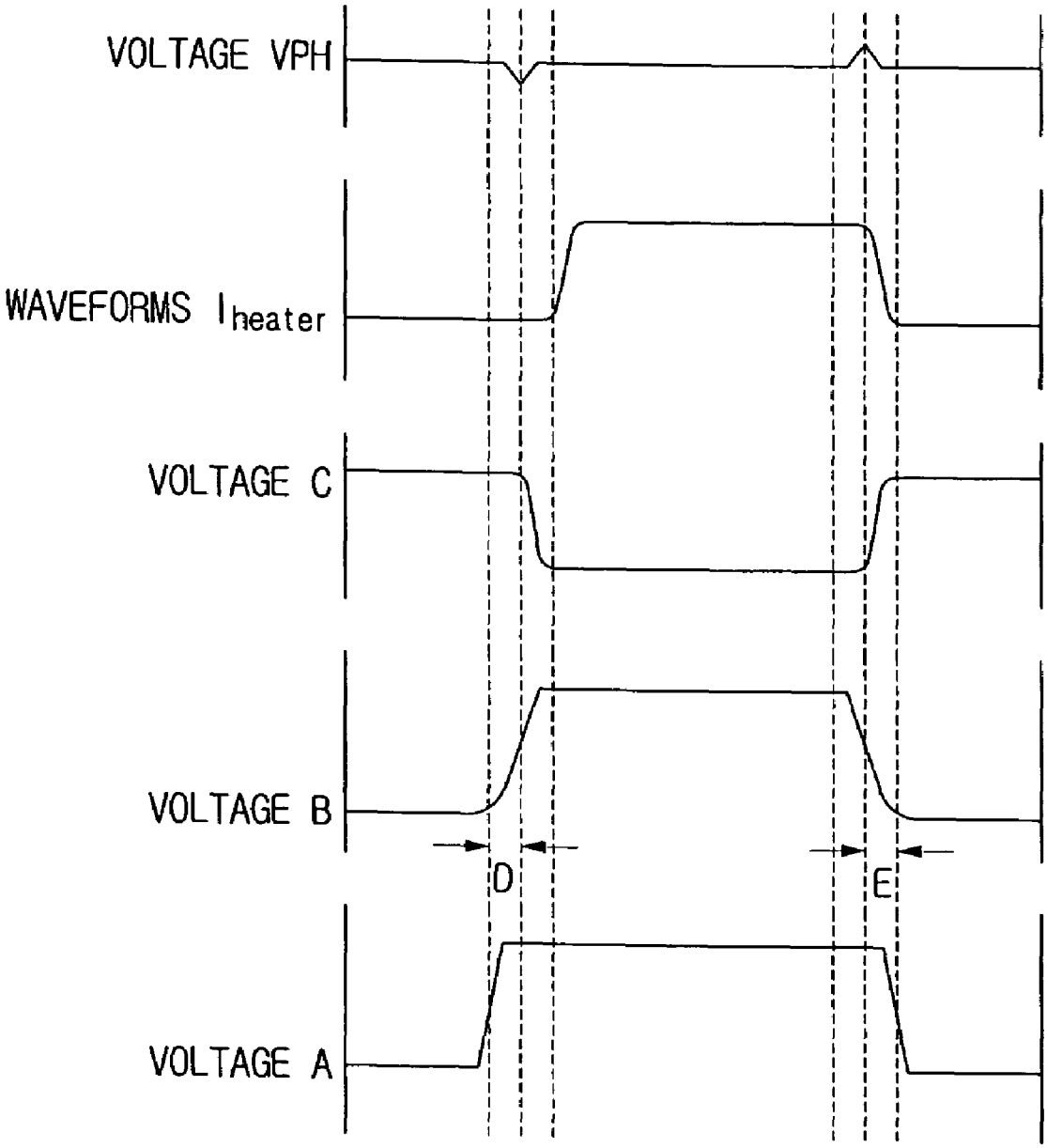
FIG. 7 is a view showing waveforms of output terminals of the level shift unit shown in FIG. 5.

FIG. 7 is a view illustrating waveforms from output terminals of the level shift unit 240 of FIG. 6. Referring to FIGS. 6 and 7, a voltage VOLTAGE A is an output voltage of the level converter 241 at a node A of FIG. 6, a voltage VOLTAGE B is an output voltage of the transient time extending part 243 at another node B of FIG. 6, and the output voltage of the level converter 241 can be verified to be delayed due to the transient time extension by the transient time extending part 243. That is, it can be verified that the voltage VOLTAGE B has an extension of time portion (section D) at its rising time during which transition is made from "low" to "high" and another extension of time portion (section E) at its falling time during which transition is made from "high" to "low" by a certain period of time, compared with the rising time and the falling time of the voltage VOLTAGE A.

The transient time of the second nozzle selection signal outputted from the second inverter 245 occurs in the rising time and the falling time. The rising time includes the extension time portion (section D) extended from the low-level signal, and a remaining time portion disposed between the extension time portion (section D) and the high-level signal. The falling time includes the extension time portion (section E) and another remaining time portion disposed between the high-level signal and the extension time portion (section E). The rising time of the second nozzle selection signal, e.g., VOLTAGE B, is extended from the rising time of the first nozzle selection signal, e.g., VOLTAGE A, by a certain period, such as the extension time portion (section D). The falling time of the second nozzle selection signal, e.g., VOLTAGE B, is extended from the falling time of the first nozzle selection signal, e.g., VOLTAGE A, by another certain period, such as the extension time portion (section E). The certain time and the another certain time may be the same. Each voltage level of the extension time portions (section D and E) is lower than that of the remaining time portion and the another remaining time portion and may be non-linear compared with the remaining time portion and the another remaining time portion.

Further, a voltage VOLTAGE C indicates a voltage discharged by the discharging part 247 at another node C of FIG. 6 if the FET 252 is turned off, and a waveform $I_R$ ($I_{Heater}$) indicates a current waveform flowing through the heating element R if the FET 252 is turned on. A driving voltage VPH indicates an output voltage of the head voltage supply Vph in a case that the driving voltage VPH of the head voltage supply Vph is induced to the heating element R when the FET 252 is turned on.

The switching unit 250 turns on and off each of the heating elements R corresponding to the selected nozzles (not shown) to eject the ink. The switching unit 250 employs the FETs 252 having gates connected to the output terminals of the level shift unit 240, drains connected to the heating elements R in series with the head voltage supply Vph, and sources grounded. The switching unit 250 is turned on and off to supply the voltage VPH to the heating elements R through the head voltage supply Vph depending upon the output signals of the level shift unit 240.

That is, the FETs corresponding to the selected nozzles are turned on so that the heating elements R corresponding to the selected nozzles are heated. Therefore, ink is ejected by the heating elements R through corresponding ones of the selected nozzles formed on the printer head.

Figure 8:
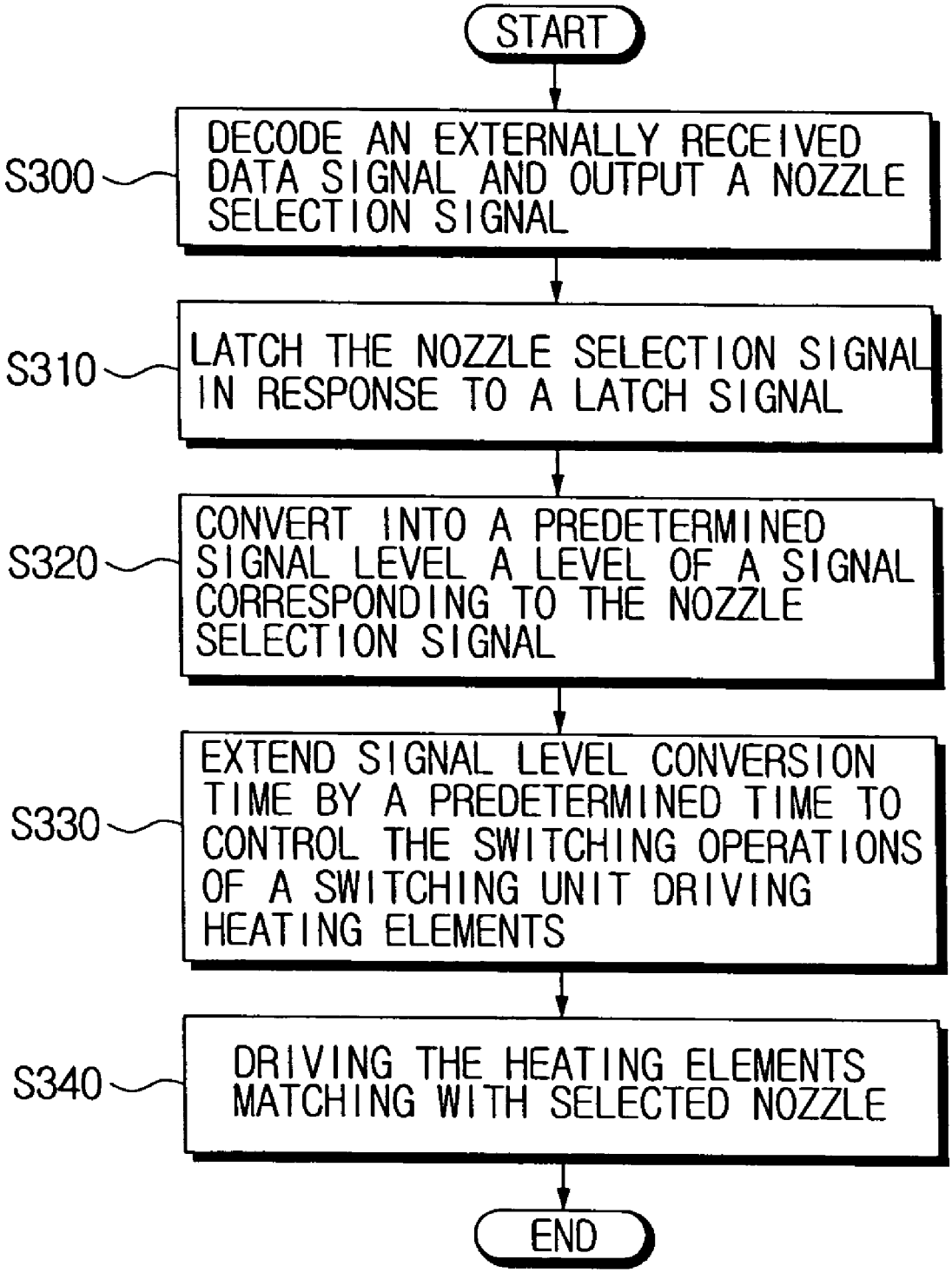
FIG. 8 is a flow chart explaining a control method used with the inkjet printer head driving apparatus of FIG. 5.

Hereinafter, a control method used with the inkjet printer head driving apparatus will be described with reference to FIG. 8.

The control unit 210 inputs and decodes the data signal transmitted from the microcomputer (not shown), and outputs in synchronization with the clock signal CLOCK a nozzle selection signal to select nozzles formed on the printer head corresponding to a to-be-printed image based on the decoded data signal in operation S300.

The nozzle selection signal outputted from the control unit 210 is latched in response to the latch signal in operation S310. Thereafter, if the strobe pulse signal STRB is inputted from the microcomputer to control a heating period of time of the heating elements R, the nozzle selection signal latched by the strobe pulse signal STRB and the latch unit 220 is inputted to the input terminals of the gate array 230.

The level converter 241 converts a potential level of a signal inputted in correspondence to a signal outputted from the gate array 230 into another potential level to drive the switching unit 250 in operation S320. That is, the level converter 241 raises a level of a signal inputted to the level converter 241 to an optimal driving potential level for the FETs 525 driving the heating elements R in a case that an output signal of the gate array 230 is a signal of logic "high."

A signal conversion by the level converter 241 is delayed for a certain period of time by the transient time extending part 243 in operation S330. That is, the transient time is extended by the certain period of time in a case that the potential level of the signal inputted from the switching unit 250 is converted from "low" to "high" or from "high" to "low."

According to the output signal of the transient time extending part 243, the switching devices corresponding to the selected nozzles are driven in operation S340. That is, the FET 252 is turned on if the output signal of the transient time extending part 243 is a high-level signal, and then the driving voltage VPH of the head voltage supply Vph is applied to the heating elements R, so that current flows through the heating elements R for the selected nozzles. Accordingly, ink is ejected from the selected nozzles.

As stated above, by extending a rising time during which the potential level of the signal inputted to the switching unit 250 is transited from "low" to "high" and a falling time during which the potential level is transited from "high" to "low," high-frequency noise, due to an impedance formed when the FETs 252 driving the heating elements R are driven, can be minimized.

As described so far, in the inkjet printer head driving apparatus and the control method thereof according to the present invention, a signal inputted to the FETs can be delayed for a predetermined period of time through delay devices so that a duration in which the FETs operate in a linear region can be extended. Accordingly, a sufficient time for charging and discharging a parasitic capacitance around the FETs is secured, and therefore, oscillation phenomena can be reduced. Further, by extending a period of time during which the FETs operate in the linear region, the malfunctions of the head driving apparatus due to noise occurring in a case that plural nozzles are driven at the same time, can be prevented.

Although a few embodiments of the present invention have been shown and described, it will be appreciated by those skilled in the art that changes may be made in these embodiments without departing from the principles and spirit of the invention, the scope of which is defined in the appended claims and their equivalents and their equivalents.

What is claimed is:

1. An inkjet printer head driving apparatus having a plurality of heating elements and nozzles, comprising:

a switching unit to turn on and off each of the heating elements to heat ink corresponding to selected nozzles to eject the ink;

a level shift unit having a level converter to convert a potential level of a signal input therein into a predetermined potential level to drive the switching unit, and a transient time extending part comprising:

a first inverter to invert the signal output from the level converter, and a second inverter including at least two time extending elements to extend the inverted signal output from the first inverter by a transient time of the output potential level of the signal input from the level converter to the switching unit during which the potential level of the signal input from the level converter to the switching unit is converted from a first signal level to a second signal level and vice versa; and a control unit to receive an external data signal, decode the received data signal, and output the decoded data signal as a nozzle selection signal to the level shift unit to select the selected nozzles corresponding to a to-be-recorded image from the nozzles.

2. The inkjet printer head driving apparatus as claimed in claim 1, further comprising a discharging part discharging a residual voltage of a signal inputted from the level shift unit to a gate of the switching unit if the switching unit switching on and off the heating elements is turned off.

3. The inkjet printer head driving apparatus as claimed in claim 2, wherein the discharging part comprises:

a first logic device connected to receive an output signal of the level converter and an output signal of the transient time extending part;

a third inverter receiving an output signal of the first logic device and having an output terminal; and a third NMOS connected to receive an output signal of the third inverter, and having a gate connected to the output terminal of the third inverter, a drain connected to an input terminal of the switching unit, and a source connected to a ground.

4. The inkjet printer head driving apparatus as claimed in claim 1, wherein the second inverter extends the transient time from the first signal level to the second signal level or a second transient time from the second signal level to the first signal level in correspondence to an output signal of the first inverter.

5. The inkjet printer head driving apparatus as claimed in claim 4, wherein the second inverter comprises:

a first PMOS having a source connected to a voltage supply and a gate and a drain commonly connected to each other;

a second PMOS having a source connected to the drain of the first PMOS and a gate connected to an output terminal of the first inverter;

a first NMOS having a gate commonly connected to the gate of the second PMOS and a drain connected to the drain of the second PMOS to form an output terminal of the second inverter; and a second NMOS having a drain and a gate commonly connected to the source of the first NMOS and a source connected to ground.

6. A control method of an inkjet printer head driving apparatus having a switching unit driving heating elements corresponding to selected nozzles to eject ink through selected nozzles, comprising:

outputting a nozzle selection signal to select nozzles corresponding to a to-be-recorded image out of the plural nozzles;

receiving an input signal corresponding to the nozzle selection signal, converting a level of the input signal to a predetermined potential level to drive the switching unit, and outputting the input signal having the converted level;

inverting the input signal having the converted level;

extending a first transient time of the output level of the inverted signal by a predetermined time in accordance with an output signal generating when the level of the inputted signal is converted, the transient time being a time period during which the level is converted from a first signal level to a second signal level;

extending a second transient time of the output level of the inverted signal by another predetermined time in accordance with an output signal generating when the level of the inputted signal is converted, the transient time being a time period during which the level is converted from the second signal level to the first signal level; and driving the heating elements corresponding to the selected nozzles to eject the ink through the selected nozzles based on the output signal from the transient time extending operation.

7. An inkjet printer head driving apparatus having a plurality of heating elements and nozzles, comprising:

a control unit to generate to control nozzle selection signal to select a heating element and a nozzle corresponding to an image to be printed;

a level shift unit including an inverter to invert the control nozzle selection signal, a first portion to generate a first nozzle selection signal having a first transient time, during which a level of the first nozzle selection signal is changed between first and second levels, in response to the inverted control nozzle selection signal, a second portion to generate a second nozzle selection signal having a second transient time extended by a period from the first transient time of the first nozzle selection signal, and a buffer to output the changed levels of the first and second selection signal; and a switching unit to turn on and off the heating element according to the second nozzle selection signal.

8. The inkjet printer head driving apparatus as claimed in claim 7, further comprising:

a discharging part discharging a residual voltage of the switching unit according to the first nozzle selection signal and/or the second nozzle selection signal.

9. The inkjet printer head driving apparatus as claimed in claim 8, wherein the switching unit comprises a transistor having a first terminal coupled to the level shift unit and the discharging part, a second terminal coupled to the heating element, and a third terminal connected to a potential, and the residual voltage of the switching unit is a voltage of the first terminal.

10. The inkjet printer head driving apparatus as claimed in claim 8, wherein the discharging part is coupled to the level shift unit to receive the first and second nozzle selection signal so that the residual voltage of the switching unit is discharged according to at least one of the first transient time of the first nozzle selection signal and the second transient time of the second nozzle selection signal when the switching unit is turned on and/or off according to the second nozzle selection signal.

11. The inkjet printer head driving apparatus as claimed in claim 7, wherein the first transient time of the first nozzle selection signal comprises a first rising transient time and a first falling transient time, during which the level of the first nozzle selection signal is changed between the first and second levels, in response to the control nozzle selection signal, and the second transient time of the second nozzle selection signal comprises a second rising transient time and a second falling transient time, during which a level of the second nozzle selection signal is changed between third and fourth levels, extended by first and second periods from the first rising transient time and the first falling transient time, respectively.

12. The inkjet printer head driving apparatus as claimed in claim 11, wherein the second rising and falling transient times are longer that the first rising and falling transient times, respectively.

13. The inkjet printer head driving apparatus as claimed in claim 7, wherein the second transient time of the second nozzle selection signal has a period longer than that of the first transient time of the first nozzle selection signal.

14. The inkjet printer head driving apparatus as claimed in claim 7, wherein the second nozzle selection signal comprises a transient level disposed between the third and fourth levels during the second transient time, and the transient level comprises a first sub-transient level and a second sub-transient level.

15. The inkjet printer head driving apparatus as claimed in claim 14, wherein one of the first and second sub-transient levels of the transient level of the second nozzle selection signal has a period longer than the first transient time of the first nozzle selection signal.

16. The inkjet printer head driving apparatus as claimed in claim 14, further comprising:

a discharging part discharging a residual voltage of the switching unit according to the first nozzle selection signal and/or the second nozzle selection signal, wherein the switching unit is turned off according to the second nozzle selection signal while the discharging part discharges the residual voltage of the switching unit according to th first transient time of the first nozzle selection signal.

17. The inkjet printer head driving apparatus claimed in claim 14, wherein the first sub-transient level is not linear between the first level and the second sub-transient level, and the second sub-transient level is linear between the first sub transient level and the second level.

18. The inkjet printer head driving apparatus as claimed in claim 7, further comprising:

a discharging part coupled to the level shift unit to receive the first and second nozzle selection signals to discharge a residual voltage of the switching unit according to the first nozzle selection signal and/or the second nozzle selection signal, wherein the first nozzle selection signal comprises a previous first nozzle selection signal and a current first nozzle selection signal, and the second nozzle selection signal comprises a previous second nozzle selection signal and a current second nozzle selection signal corresponding to the previous first nozzle selection signal and the current first nozzle selection signal of the first nozzle selection signal, respectively, and the voltage of the switching unit is a residual voltage remaining in the switching unit when the switching unit is turned off according to the previous second nozzle selection signal.

19. The inkjet printer head driving apparatus as claimed in claim 18, wherein the voltage of the switching unit is another residual voltage remaining in the switching unit when the switching unit is turned off according to the current second nozzle selection signal.

20. The inkjet printer head driving apparatus as claimed in claim 7, wherein the first nozzle selection signal comprises a first rising transient time and a first falling transient times disposed between the first and second levels, the second nozzle selection signal comprises third and fourth levels and second rising and falling transient times disposed between the third and fourth levels, and the third level of the second nozzle election signal is disposed between the second rising and falling transient times of the second nozzle selection signal and has a period shorter than that of the first level of the first nozzle selection signal disposed between the first rising and falling transient times of the first nozzle selection signal.

21. The inkjet printer head driving apparatus as claimed in claim 20, further comprising:

a discharging part coupled to the level shift unit to receive the first and second nozzle selection signals to discharge a residual voltage of the switching unit according to the second rising transient times of the second nozzle selection signal before the switching unit is turned on according to one of the third and fourth levels of the second nozzle selection signal.

22. The inkjet printer head driving apparatus as claimed in claim 21, wherein the discharging part discharges the residual voltage of the switching unit according to the second rising transient times of the second nozzle selection signal before the switching unit is turned off according to one of the third and fourth levels of the second nozzle selection signal.

23. The inkjet printer head driving apparatus as claimed in claim 7, wherein the switching unit comprises an FET, and a turning-on time of the FET is delayed by the period during which the first transient time of the first nozzle selection signal is extended to the second transient time of the second nozzle selection signal, to provide a sufficient time to charge and discharge a parasitic capacitance around the FET.

24. The inkjet printer head driving apparatus as claimed in claim 7, wherein the control nozzle selection signal comprises on and off signals to turn on and off the switching unit corresponding to the heating element, the level shift unit comprises a level converter to convert the control nozzle selection signal into the first nozzle selection signal having the first and second levels which are different from the on and off signals in signal level, respectively.

25. The inkjet printer head driving apparatus as claimed in claim 24, wherein a time taken to convert the on and off signal of the control nozzle selection signal into the first and second levels of the first nozzle selection signal is compensated by extending the first transient time of the first nozzle selection signal to th second transient time disposed between third and fourth levels of the second nozzle selection signal which correspond to the first and second levels of the first nozzle selection signal, respectively.

26. The inkjet printer head driving apparatus claimed in claim 25, wherein the switching unit is turned on according to the fourth level of the second nozzle selection signal, and a time period of the fourth level of the second nozzle selection signal is shorter than that of the second level of the first nozzle selection signal.

27. The inkjet printer head driving apparatus as claimed in claim 25, wherein a total period of the second transient time and the fourth level of the second nozzle selection signal is the same as that of the first transient time and the second level of the first nozzle selection signal.

28. The inkjet printer head driving apparatus as claimed in claim 25, further comprising:

a discharging part discharging a residual voltage of the switching unit according to the first and second nozzle selection signals.

29. The inkjet head driving apparatus as claimed in claim 28, wherein the discharging part is changed between a turned-on state and a turned off state during a portion of the second transient time of the second nozzle selection signal to discharge the residual voltage of the switching unit and/or stop discharging the residual voltage of the switching unit according to the third level of the second nozzle selection signal.

30. An inkjet head driving unit, comprising:

a control unit to generate a nozzle selection signal to select a nozzle having a heating element;

a level shift unit to convert the nozzle selection signal to have a predetermined level to drive the heating element between a logic high and a logic low, and having an inverter to invert the converted nozzle selection signal, and first and second logic units to increase a time required to change the inverted nozzle selection signal between the logic high and the logic low; and a switching unit to turn the heating element on and off according to the output of the level shift unit.

* * * * *